US005343649A

United States Patent [19]

Petrovich

[11] Patent Number: 5,343,649

[45] Date of Patent: Sep. 6, 1994

[54] SPIRAL RECOIL ABSORBER

[76] Inventor: Paul A. Petrovich, 11269 Judd Rd., Fowlerville, Mich. 48836

[21] Appl. No.: 118,348

[22] Filed: Sep. 9, 1993

[51] Int. Cl.[5] ..... F41A 25/14; F41A 25/18
[52] U.S. Cl. ..... 42/1.06; 89/43.01
[58] Field of Search ..... 89/43.01, 44.01, 42.01, 89/198, 177; 42/1.06

[56] References Cited

U.S. PATENT DOCUMENTS

| | | | |
|---|---|---|---|
| 833,616 | 10/1906 | Mondragon | 89/43.01 |
| 3,290,815 | 12/1966 | Edwards | 42/1.06 |
| 3,603,577 | 9/1971 | DeRaad | 89/198 |
| 4,164,825 | 8/1979 | Hutchison | 42/1.06 |
| 5,044,351 | 9/1991 | Pfeiffer | 42/1.06 |

FOREIGN PATENT DOCUMENTS

| | | | |
|---|---|---|---|
| 351501 | 1/1990 | European Pat. Off. | 42/1.06 |
| 14548 | of 1885 | United Kingdom | 42/78 |

*Primary Examiner*—Stephen M. Johnson
*Attorney, Agent, or Firm*—Peter A. Taucher; David L. Kuhn

[57] ABSTRACT

A specialized recoil absorber mounted to a gun dampens and absorbs the recoil force of a gun during the firing thereof. The recoil absorber includes a closed, fluid filled cylinder having a first end and a second end. A piston closely fits within the cylinder and slides therein along the cylinders longitudinal axis and a spring is compressed between the piston and the first end. The cylinder defines channels at an outer diametrical surface thereof, the channels having a helical twist centered on the longitudinal axis, whereby the piston rotates as it translates.

11 Claims, 2 Drawing Sheets

SPIRAL RECOIL ABSORBER

GOVERNMENT USE

The invention described herein may be manufactured, used and licensed by or for the U.S. Government for governmental purposes without payment to me of any royalty thereon.

BACKGROUND AND SUMMARY

When a projectile is fired from a rifled gun barrel, the projectile and barrel exert rotational force on one another. The rotational force exerted on the gun barrel moves the barrel up, down or sideways as the gun is fired, whereby the gun's accuracy is impaired. I address this problem via my novel recoil shock absorber for guns. This recoil absorber has a piston in a fluid filled cylinder. The piston not only translates relative to the cylinder to absorb the backward recoil force component on the gun but also spins to counteract the rotational force imparted to the gun by the projectile. The piston's rotation is effected by channels thereon which have helical twists centered on a common axis of the cylinder and piston. As the piston translates during recoil, fluid flowing through the channels rotates the piston. My recoil absorber also has means to controlledly vary the spin rate of the piston, thereby allowing the recoil absorber to compensate for differing angular forces imparted to the gun by differing kinds of projectiles fired therefrom.

DETAILED DESCRIPTION

Figure 1:
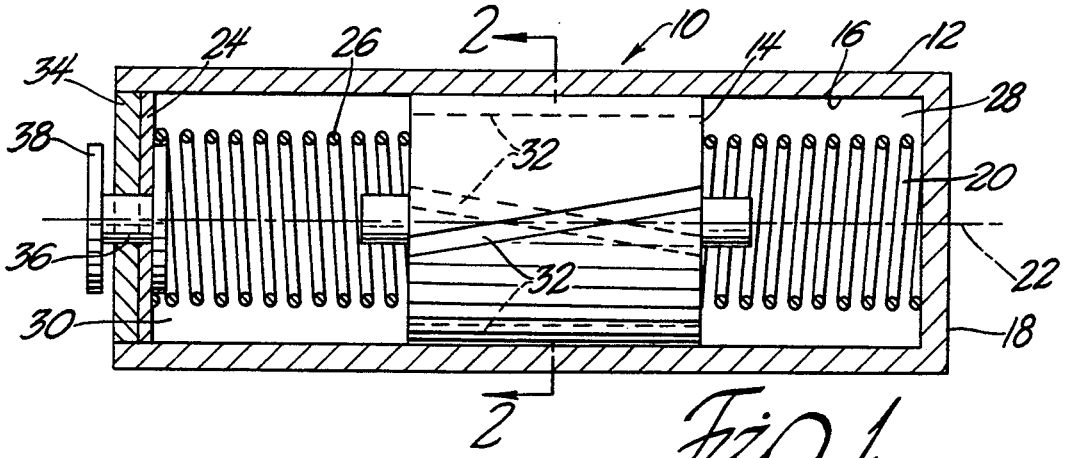
FIG. 1 is a longitudinal sectional view of a first embodiment of my recoil absorber.
Figure 2:
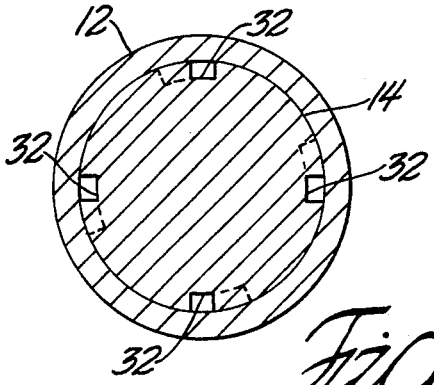
FIG. 2 is a view taken along line 2—2 in FIG. 1.

FIG. 1 shows a spiral recoil absorber 10 comprised of a closed, sealed cylinder 12 with a piston 14 closely but slidably fit against the cylinder's inner diametrical wall 16. Compressed between the piston and one cylinder end 18 is a coil spring 20, which fixedly attaches to piston 14, bears against wall 18 and rotates about longitudinal cylinder axis 22 with piston 14. Fixed between the piston and compressable spring disk 24 is another coil spring 26, which rotates together with the piston, spring 20 and disk 24 about axis 22.

Respective cavities 28 and 30 containing springs 20 and 26 are filled with a liquid such as oil or hydraulic fluid. These cavities are communicated to one another by a plurality of diagonal, equally spaced channels 32 on the outer diameter of piston 14. The orientation of the channels causes the piston and springs to rotate about axis 22 when the piston translates relative to cylinder 12. The rotation is due to the interaction of the channels with the liquid in the cavities.

A removable end wall 34 is sealingly affixed to cylinder 12 by any suitable, known means, and disk 24 faces rotatably against wall 34. As seen in both FIGS. 1 and 8, there is a finely threaded shaft 36 fixed to disk 24 and passed through wall 34, the engagement between the wall and shaft being sealed by any appropriate, known means. Attached to this shaft is a round head 38, and turning the head adjusts the tightness with which disk 24 bears against wall 34.

Figure 8:
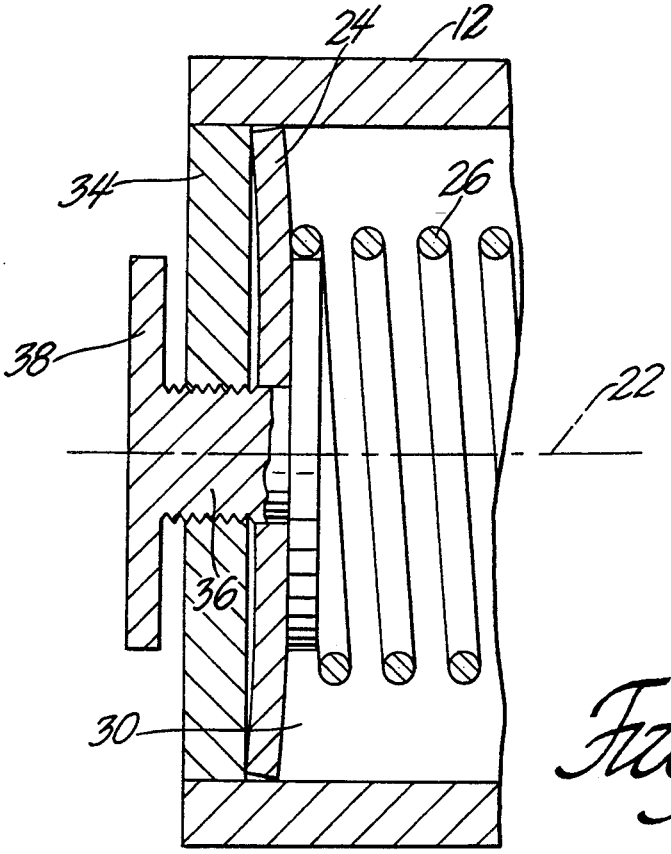
FIG. 8 is a detail sectional view showing an adjustment mechanism for selectively retarding rotation of the piston within my recoil absorber.

In FIG. 8, plate 24 is shown in a free state, before it has been compressed against wall 34 by the turning of shaft 34, so that plate 24 defines a slight concavity open toward wall 34. The tightness with which disk 24 is pressed against wall 34 controls the degree of anti-rotational retardation effected upon spring 26, piston 14 and spring 20. It is intended that the angular momentum of piston 14 occurring at rifle recoil will be equal and opposite to the angular momentum imparted to the rifle by projectile fired therefrom. Consequently, the rifle is steadier and more accurate when it is fired.

Figure 3:
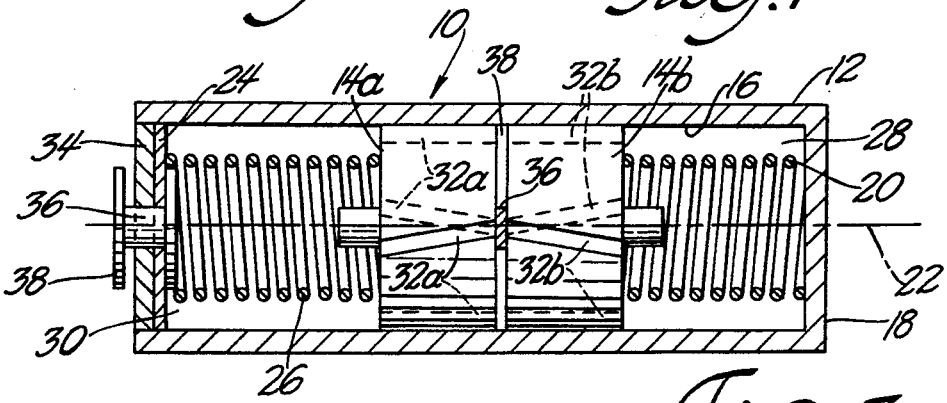
FIG. 3 is a longitudinal sectional view of a second embodiment of my invention.

FIG. 3 shows a modified version 10*a* of recoil absorber 10, the modified version being in all respects similar to recoil absorber 10 except that pistons 14*a* and 14*b* replace piston 14. Channels 32*a* on piston 14*a* are spiraled in the opposite angular direction from channels 32*b* on piston 14*b* so that these pistons will rotate in opposite directions when translating in the same axial direction. Pistons 14*a* and 14*b* are of the same shape and mass so that their angular momenta cancel. A button bushing 36 is fixed to either piston 14*a* or 14*b* and is rotatable relative to the other, the bushing separating the pistons to define gap 38 therebetween. Gap 38 assures fluid communication between channels 32*a* and 32*b* whenever the channels rotate out of the alignment with one another shown in FIG. 3. Optionally, piston 14*a* has greater mass, or at least a greater moment of rotational inertia than piston 14*b* and the rotation of piston 14*a* can be controlledly retarded by turning head 38 to tighten disk 24 against wall 34. In this fashion, the relative angular momentum of piston 14*a* can be adjusted to be more, less, or the same as the angular momentum of piston 14*b*.

Figure 4:
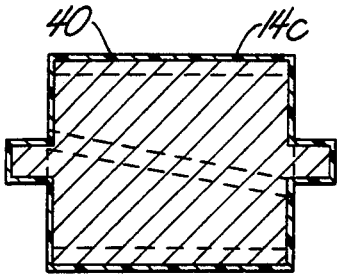
FIG. 4 is a longitudinal sectional view of a modified piston for my recoil absorber.
Figure 5:
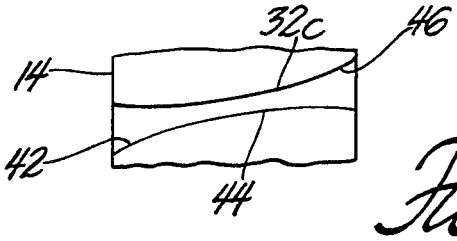
FIG. 5 is a detail view showing a modified channel on the piston within the recoil absorber.

FIGS. 4 and 5 show further optional details of my recoil absorber. In FIG. 4, a piston 14*c* is similar to piston 14 except that piston 14*c* is not of solid metal. Instead, piston 14*c* has an outer layer 40 made of a relatively low friction material such as nylon or teflon, whereby piston 14*c* can slide more freely against inner diametrical wall 16 of cylinder 12. FIG. 5 shows a portion of piston 14 wherein a modified channel 32*c* having flared openings 42 and 46 at either end thereof and a relatively straighter, narrower intermediate zone 44. The flared openings reduce fluid turbulence at the ends of the channel when piston 14 translates along axis 22 in cylinder 12.

Figure 6:
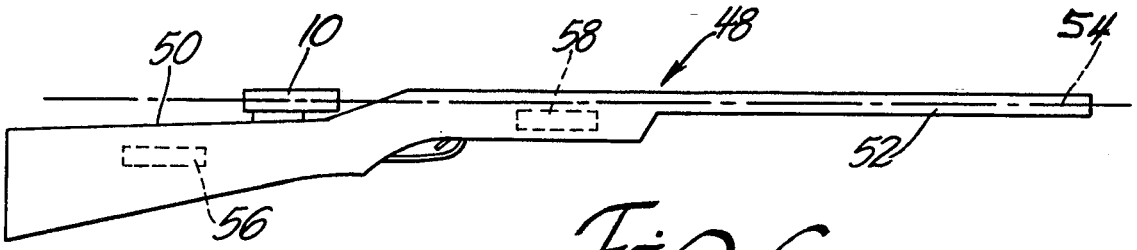
FIG. 6 is a side elevational view of a rifle showing possible locations thereon of the recoil absorber.

In FIG. 6 are shown possible locations for recoil absorber 10 in a conventional rifle 48. Preferably, recoil absorber 10 is fixedly mounted atop the forward portion of buttstock 50 coaxially with barrel 52 along common axis 54. Optionally, the recoil absorber can be placed in the buttstock at location 56 or in the rifle's forearm at location 58.

Figure 7:
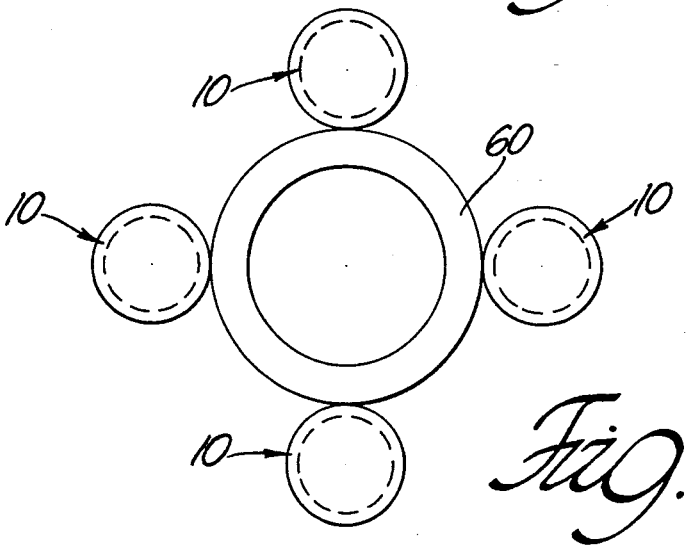
FIG. 7 is an end view of a gun barrel showing an array of my recoil absorbers disposed thereon.

FIG. 7 shows an end view of a unrifled gun barrel 60 having a plurality of recoil absorbers 10 disposed thereon at equiangular intervals about barrel axis 62.

I wish it to be understood that I do not desire to be limited to the exact details of construction or method shown herein since obvious modifications will occur to those skilled in the relevant arts without departing from the spirit and scope of the following claims.

I claim:

1. A device mounted to a gun for dampening and absorbing the recoil of the gun during the firing thereof, comprising:

means for mounting the device to the gun;

a cylinder having a first end and a second end;

liquid in the cylinder;

a longitudinal axis of the cylinder;

a piston in the cylinder axially sliding therein;

a spring between the piston and the first end;

the piston defining a channel having a helical twist relative to the longitudinal axis;

adjustment means for varying a rate of piston rotation for a given spring force.

2. The device of claim 1 wherein the spring between the piston and the first end is a first spring compressed between the piston and the first end, the device further comprising a second spring compressed between the piston and the second end.

3. The device of claim 1 wherein the spring is a coil spring disposed along the longitudinal axis and fixed to the piston and rotatable therewith in the cylinder, whereby the spring and piston form a unified rotational body.

4. The device of claim 1 wherein the adjustment means comprises:

a disk fixed to the spring, at least a portion of the disk bearing against the first end;

a fixed connection between the spring and the piston;

a shaft through the first end threadingly engaged with the first end;

a connection between the disk and the shaft such that turning the shaft continuously changes an area of the disk which frictionally bears against the first end.

5. A device mounted to a gun for dampening and absorbing the recoil of a gun during the firing thereof, comprising:

means for mounting the device to the gun;

a closed cylinder having a first end and a second end;

liquid in the cylinder;

a longitudinal axis of the cylinder;

a first piston axially sliding in the cylinder;

a second piston axially sliding in the cylinder;

a spring between the first piston and the first end;

the first piston defining a first channel helically twisting in one angular direction about the longitudinal axis;

the second piston defining a second channel helically twisting in an opposite angular direction about the axis.

6. The device of claim 5 wherein the spring between the first piston and the first end is a first spring compressed between the first piston and the first end, the device further comprising a second spring compressed between the second piston and the second end.

7. The device of claim 6 wherein the first spring is fixed to the first piston and the second spring is fixed to the second piston, the first spring rotating with the first piston and the second spring rotating with the second piston.

8. The device of claim 7 further comprising:

a bushing between the pistons;

an annular gap defined by the pistons and surrounding the bushing, the gap communicating the first channels to the second channels.

9. The device of claim 8 further including adjustment means for controllingly retarding rotation of the first piston in the cylinder.

10. The device of claim 9 wherein the adjustment means comprises:

a disk fixed to the first spring and disposed between the first spring and the first end, the disk bearing against the first end;

a shaft through the first end threadingly engaged with the first end;

a solid connection between the disk and the shaft, whereby turning the shaft affects the degree to which the disk presses against the first end.

11. The device of claim 10 wherein a moment of rotational inertia of the first piston is greater than a moment of rotational inertia of the second piston.

* * * * *